US007618095B2

(12) United States Patent
Nielsen

(10) Patent No.: US 7,618,095 B2
(45) Date of Patent: Nov. 17, 2009

(54) CHAIR OR A BED HAVING A SEAT, A BACKREST AND AN ARMREST AS WELL AS USE THEREOF

(75) Inventor: Thomas Steen Nielsen, Brøndby (DK)

(73) Assignee: Heka Dental A.p.S., Ishoj (DK)

( * ) Notice: Subject to any disclaimer, the term of this patent is extended or adjusted under 35 U.S.C. 154(b) by 0 days.

(21) Appl. No.: 11/995,346

(22) PCT Filed: Jul. 14, 2006

(86) PCT No.: PCT/DK2006/000416

§ 371 (c)(1),
(2), (4) Date: Mar. 11, 2008

(87) PCT Pub. No.: WO2007/014564

PCT Pub. Date: Feb. 8, 2007

(65) Prior Publication Data

US 2008/0303329 A1 Dec. 11, 2008

(30) Foreign Application Priority Data

Aug. 4, 2005 (DK) ..... 2005 01114

(51) Int. Cl.
*A47C 1/02* (2006.01)
*A47C 1/032* (2006.01)

(52) U.S. Cl. ..... 297/411.44; 297/330

(58) Field of Classification Search ..... 297/411.44, 297/330; D6/500, 501, 502, 379, 380
See application file for complete search history.

(56) References Cited

U.S. PATENT DOCUMENTS 477,906 A * 6/1892 Lockstaedt ..... 297/79
2,163,078 A * 6/1939 Zerbee ..... 297/411.44 X
2,592,025 A * 4/1952 McCormick Gray ... 297/411.44 X
3,089,741 A * 5/1963 Burton ..... 297/78 X
3,357,740 A * 12/1967 Vaughn et al. ..... 297/411.44 X
3,536,355 A * 10/1970 Osbeck ..... 297/71

(Continued)

FOREIGN PATENT DOCUMENTS

DE 9102086 U 6/1992

(Continued)

OTHER PUBLICATIONS

International Search Report.

*Primary Examiner*—Rodney B White
(74) *Attorney, Agent, or Firm*—William J. Sapone; Coleman Sudol Sapone P.C.

(57) ABSTRACT

A chair (1), in particular a dentist's chair, which has a seat (3) and a backrest (2) which are connected with each other by means of a hinge (6) consisting of two movable parts in the from of an inner ring (8) and an outer ring (7) disposed concentrically therewith. The inner ring (8) is secured to the seat (3), while the outer ring (7) is secured to the sear (3). The outer side of the inner ring (8) engages the inner side of the outer ring (7), a ball bearing (11, 12) being mounted between the inner ring (8) and the outer ring (7). The invention provides a dentist's chair where the armrest follows the movement of a user's back.

12 Claims, 3 Drawing Sheets

U.S. PATENT DOCUMENTS 3,806,192 A * 4/1974 Ohlrogge et al. .... 297/411.44 X
4,242,086 A * 12/1980 Jorg ..... 433/33
RE30,648 E * 6/1981 Ohlrogge et al. .... 297/411.44 X
4,441,756 A * 4/1984 Liou et al. ..... 297/411.44 X
4,492,407 A 1/1985 Broadhead
5,102,196 A * 4/1992 Kaneda et al. ..... 297/411.44 X
5,114,212 A * 5/1992 Verney et al. ..... 297/411.44 X
5,318,346 A * 6/1994 Roossien et al. .... 297/411.44 X

FOREIGN PATENT DOCUMENTS

EP 62724 A1 * 10/1982 ..... 297/411.44
GB 2068719 A * 8/1981 ..... 297/411.44
WO WO 94/19991 A 9/1994

* cited by examiner

CHAIR OR A BED HAVING A SEAT, A BACKREST AND AN ARMREST AS WELL AS USE THEREOF

BACKGROUND

The object of the invention is achieved by a chair which is characterized in that the backrest and the seat are secured to each other by means of the armrest, which is formed by a hinge consisting of two mutually movable parts, where the one part is secured to the seat, while the other part is secured to the backrest. Hereby, the armrest will follow the movement of the backrest.

A particularly expedient way of hinging the backrest to the seat is that the two mutually movably parts are configured as an inner ring and an outer ring which are disposed concentrically, where the outer side of the inner ring engages the inner side of the outer ring.

Further, it is expedient if a bearing, such as a ball bearing, is mounted between the inner ring and the outer ring, and, as stated in claim 4, that the inner ring is secured to the seat, while the outer ring is secured to the backrest.

A further comfort-enhancing feature of the chair is that the outer side of the outer ring is padded.

As mentioned, the invention also relates to a use. This use is defined as use as a dentist's chair.

The invention relates to a chair or a bed, which comprises a seat or a support, a backrest and an armrest, where the back is movable relative to the seat.

The invention moreover relates to use of the chair or the bed.

Such a chair is known from WO 94/19991 A1. In this known chair, the backrest may be moved relative to the seat, as the backrest may be moved by means of a sliding arrangement which is provided between the armrest of the chair and the legs of the chair. Thus, the armrest itself cannot be moved.

Accordingly, an object of the invention is to provide a chair, where the backrest follows the movement of the armrest, which involves a greater comfort for a user of the chair and ensures that the headrest/back can only move minimally after adjustment.

The object of the invention is achieved by a chair of the type defined in the introductory portion of claim 1, which is characterized in that the backrest and the seat are secured to each other by means of the armrest, which is formed by a hinge consisting of two mutually movable parts, where the one part is secured to the seat, while the other part is secured to the backrest. Hereby, the armrest will follow the movement of the backrest.

A particularly expedient way of hinging the backrest to the seat is, as defined in claim 2, that the two mutually movable parts are configured as an inner ring and an outer ring which are disposed concentrically, where the outer side of the inner ring engages the inner side of the outer ring.

Further, it is expedient if, as stated in claim 3, a bearing, such as a ball bearing, is mounted between the inner ring and the outer ring, and, as stated in claim 4, that the inner ring is secured to the seat, while the outer ring is secured to the backrest.

A further comfort-enhancing feature of the chair is that the outer side of the outer ring is padded, as stated in claim 5.

As mentioned, the invention also relates to a use. This use is defined in claim 6.

BRIEF DESCRIPTION OF THE DRAWINGS

The invention will now be explained with reference to the drawing, in which

FIG. 2 shows a lateral section of the chair of FIG. 1, while

DETAILED DESCRIPTION OF THE INVENTION

Figure 1:
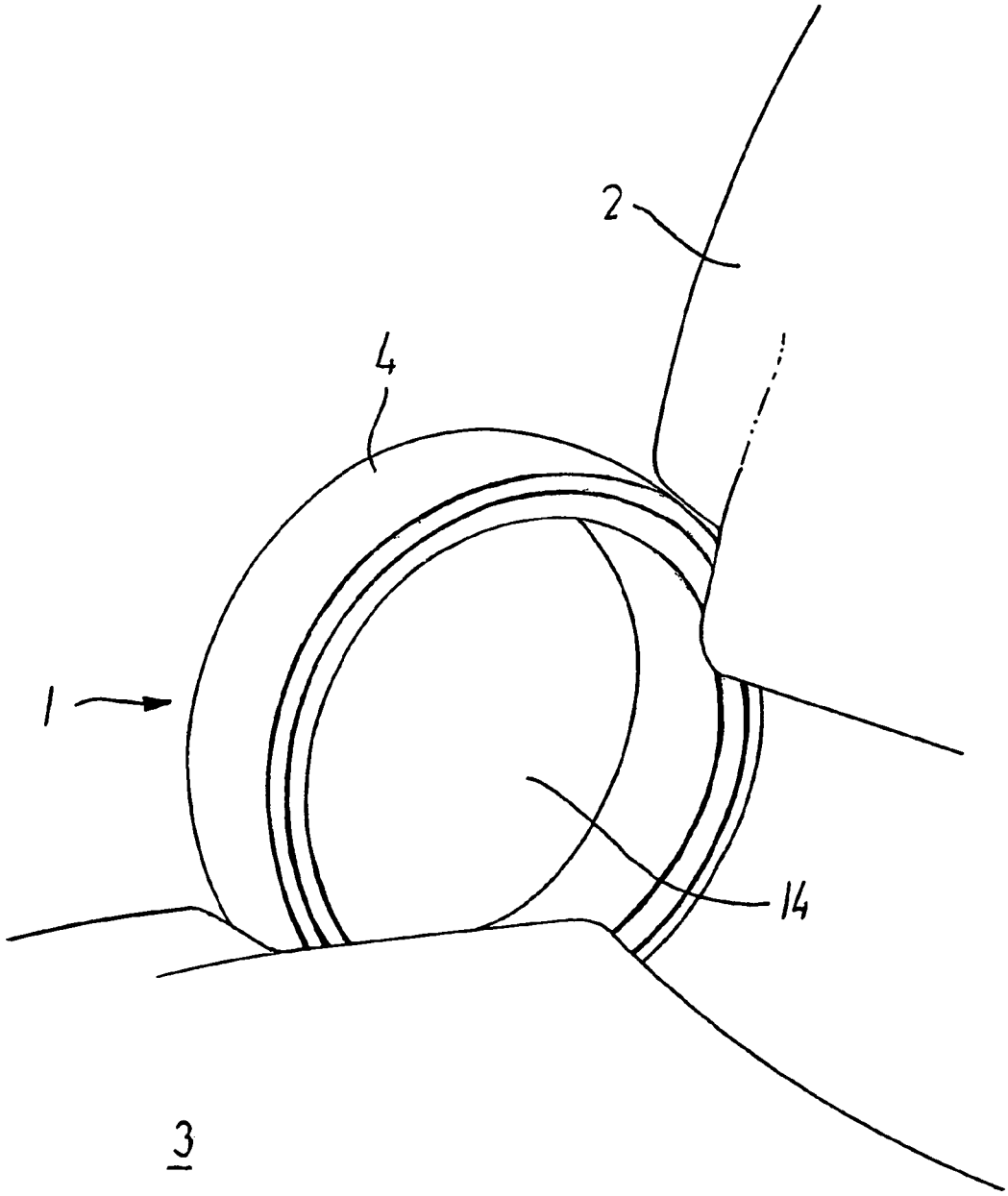
FIG. 1 shows the basic structure of a chair according to the invention.

In FIG. 1, the numeral 1 designates a chair as a whole, which is shown here as a dentist's chair.

The chair has a backrest 2 which is connected with a seat 3 by means of two armrests 4 (only one is shown), as will be explained later.

Figure 2:
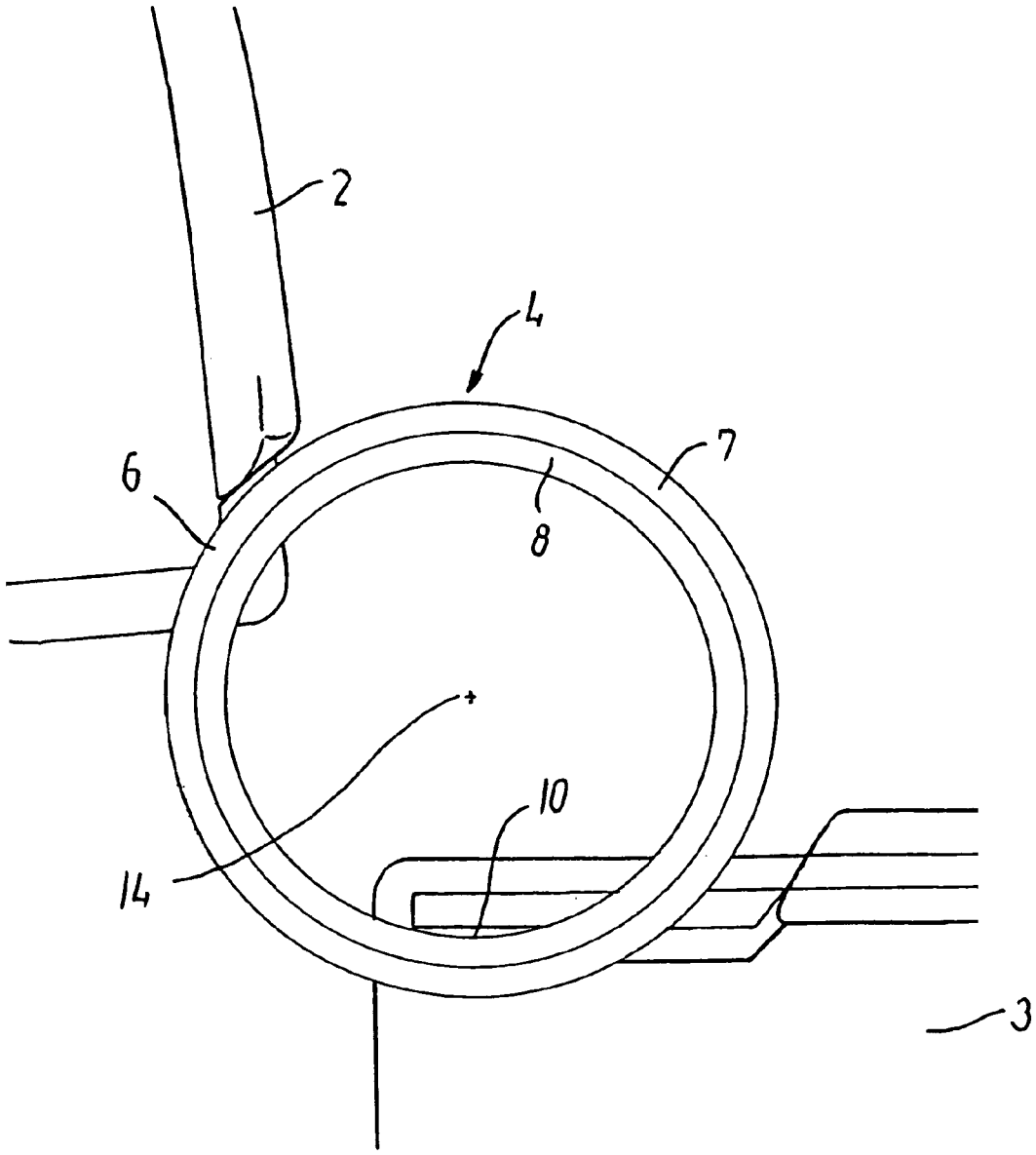
Figure 3:
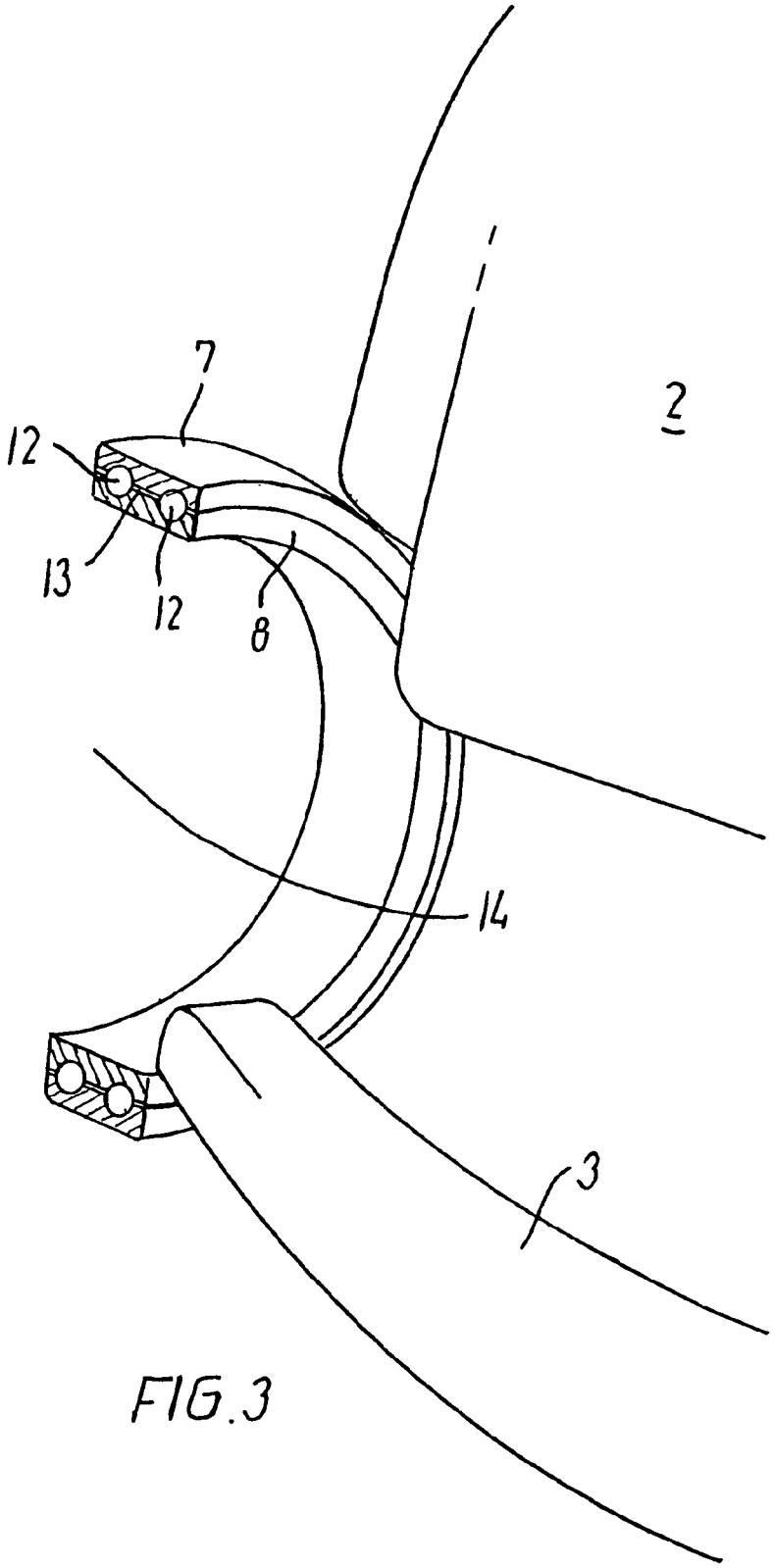
FIG. 3 shows how the armrest for the chair is constructed.

As will be seen in FIGS. 2 and 3, the armrest 4 consists of an inner ring 8 which is secured to the seat 3, as shown at 10, by means of a bolt (not shown) or the like.

An outer ring 7 is provided concentrically with the inner ring 8, said outer ring being secured to the backrest 2, as shown at 6, by means of a bolt (not shown) or the like. A padding may be provided on the outer side of the outer ring.

The outer ring 7 and the inner ring 8 may be rotated relative to each other about a pivot 14, a bearing, cf. FIG. 3, being arranged between the outer ring and the inner ring, as shown at 11, 12.

As will be seen, the pivot 14 is disposed between the seat 3 and the backrest 2.

Finally, there is a small gap 13 between the outer ring 7 and the inner ring 8.

It should be noted that the movement between the inner ring and the outer ring may be provided by a motor (not shown) and/or by a pushing movement on the backrest and/or bracket/unit which is secured to the backrest.

The chair is operated in the following manner:

When a person sits in the chair and moves the backrest up or down, the outer ring of the armrest and the backrest will follow the movement and rotate relate to the inner ring, which gives a great user comfort, since a user need not release the armrest during the movement of the backrest or let his hand slide on the armrest.

The invention claimed is:

1. A chair (1) comprising a seat (3), a backrest (2) and an armrest (6), the backrest being movable relative to the seat, the backrest (2) and the seat (3) being secured to each other by means of the armrest (6), the armrest being formed by a hinge consisting of two mutually movable parts (7, 8), a first movable part being secured to the seat (3), a second movable part being secured to the backrest (2), the two mutually movable parts being configured as an inner ring (8) and an outer ring (7) which are disposed concentrically, an outer side of the inner ring engaging an inner side of the outer ring, such that as the backrest moves relative to the seat, the first movable part moves with the backrest, relative to the second movable part secured to the seat.

2. A chair according to claim 1 wherein the outer side of the inner ring engages the inner side of the outer ring and further comprising a bearing guide therebetween.

3. A chair according to claim 2, characterized in that the inner ring (8) is secured to the seat (3), while the outer ring (7) is secured to the backrest (2).

4. A chair according to claim 3, characterized in that an outer side of the outer ring (7) is padded.

5. A chair according to claim 2, characterized in that an outer side of the outer ring (7) is padded.

6. A chair according to claim 2, characterized in that a bearing (11, 12) is mounted between the inner ring (8) and the outer ring (7).

7. A chair according to claim 6 wherein the bearing is a ball bearing.

8. A chair according to claim 1, characterized in that a bearing (11, 12) is mounted between the inner ring (8) and the outer ring (7).

9. A chair according to claim 8 wherein the bearing is a ball bearing.

10. A chair according to claim 8, characterized in that the inner ring (8) is secured to the seat (3), while the outer ring (7) is secured to the backrest (2).

11. A chair according to claim 8, characterized in that an outer side of the outer ring (7) is padded.

12. A chair according to claim 1 wherein the chair is a dentist's chair.

* * * * *